US009216568B2

(12) United States Patent
Stowe

(10) Patent No.: US 9,216,568 B2
(45) Date of Patent: Dec. 22, 2015

(54) KEYLESS INKING METHODS, APPARATUS, AND SYSTEMS WITH CHAMBER BLADE SYSTEM SPANNING ANILOX ROLL AND FORM ROLL FOR DIGITAL OFFSET PRINTING

(75) Inventor: Timothy David Stowe, Alameda, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 1118 days.

(21) Appl. No.: 13/251,144

(22) Filed: Sep. 30, 2011

(65) Prior Publication Data

US 2013/0081549 A1 Apr. 4, 2013

(51) Int. Cl.

| | |
|---|---|
| ***B41F 1/18*** | (2006.01) |
| ***B41F 31/02*** | (2006.01) |
| ***B41F 31/20*** | (2006.01) |
| ***B41M 1/06*** | (2006.01) |
| *B41N 3/08* | (2006.01) |
| *B41C 1/10* | (2006.01) |

(52) U.S. Cl.

CPC ..... *B41F 31/027* (2013.01); *B41F 31/20* (2013.01); *B41M 1/06* (2013.01); *B41C 1/1008* (2013.01); *B41N 3/08* (2013.01); *B41P 2227/70* (2013.01); *B41P 2231/20* (2013.01)

(58) Field of Classification Search

CPC ..... B41F 31/20; B41F 31/04; B41F 31/007; B41F 31/027; B41P 2235/22; B41P 2231/20

See application file for complete search history.

(56) References Cited

U.S. PATENT DOCUMENTS

| | | | | |
|---|---|---|---|---|
| 3,926,114 | A * | 12/1975 | Matuschke | 101/142 |
| 4,041,864 | A * | 8/1977 | Dahlgren et al. | 101/350.4 |
| 4,452,139 | A * | 6/1984 | Dahlgren et al. | 101/148 |
| 4,527,479 | A * | 7/1985 | Dahlgren et al. | 101/450.1 |
| 5,372,067 | A * | 12/1994 | Doyle | 101/148 |
| 8,893,616 | B2 * | 11/2014 | Liu | 101/425 |
| 2013/0025487 | A1 * | 1/2013 | Liu | 101/425 |

OTHER PUBLICATIONS

Timothy Stowe et. al.; Variable Data Lithography Systems; U.S. Appl. No. 13/095,714.

* cited by examiner

*Primary Examiner* — Jennifer Simmons

(74) *Attorney, Agent, or Firm* — Ronald E. Prass, Jr.; Prass LLP

(57) ABSTRACT

A variable lithographic inking system includes a chamber blade system configured to supply ink to an anilox member of an inking system. The inking system includes a soft ink transfer roll and a hard form roll. Ink is transferred from the anilox roll to the form roll by way of the transfer roll, and from the form roll to a reimageable surface layer of an imaging member of a variable data lithographic system. An ink layer free of ink history is uniformly applied onto a surface of the form roll, and subsequently transferred to the reimageable surface layer while avoiding or substantially eliminating image ghosting related to inking non-uniformities.

11 Claims, 4 Drawing Sheets

KEYLESS INKING METHODS, APPARATUS, AND SYSTEMS WITH CHAMBER BLADE SYSTEM SPANNING ANILOX ROLL AND FORM ROLL FOR DIGITAL OFFSET PRINTING

RELATED APPLICATION

The disclosure relates to "Variable Data Lithography Systems" to Stowe et. al., U.S. patent application Ser. No. 13/095,714, the disclosure of which is incorporated herein by reference in its entirety.

FIELD OF DISCLOSURE

The disclosure relates to variable data lithographic printing. In particular, the disclosure relates to keyless inking methods and inking systems for use in variable data lithographic printing systems.

BACKGROUND

Traditional offset printing does not allow for variable data printing. The inking subsystem used applies ink over a static plate image. Typically, ink is depleted from an inker form roll as the ink is transferred onto the imaging plate, the ink form roller being the last roller that is in direct contact with the imaging plate. Different regions of the imaging plate may need more or less ink depending upon which regions are oleophilic foreground areas and which regions are oleophobic background image areas. Traditional offset ink delivery systems adjust ink flow to different regions of the plate using manually adjusted keys which change the ink feed rate in order to guarantee enough ink will flow in solid imaging regions but prevent too much ink from flowing to areas covered by fine lines or half tones.

Recently, keyless inker systems have been introduced which meter ink appropriately without the need for inker keys. Exemplary keyless inker systems include those sold by Koenig & Bauer AB group (KBA) located in Germany. Such keyless systems use a metered anilox roller to pull fresh ink uniformly out of an ink tray and deliver the ink directly to a rubber form roll which then transfers the ink to the an imaging plate. Such systems provide for more consistent ink flow regardless of whether a solid or fine artwork is being printed. However, the ink thickness that remaining on the form roller after being partially transferred to the static image on an offset plate is not uniform. This is because ink splits onto the imaging plate in imaging areas but is fully rejected in non-imaging areas by the dampening fluid. Thus the remaining non-uniform ink thickness on the form roller has a thickness pattern which reflects the image pattern printed onto the static plate. Thus not all areas on the form roll are covered with the same thickness of ink after transfer of ink onto the imaging plate and when new ink is transferred onto the form roller some of the old thickness pattern partially remains. To minimize these effects, keyless inking systems include a form roll that has a soft or conformable surface, an anilox metering roll, and imaging plate that are all substantially equal in diameter. Further, since these rollers are all of equal diameter, related art keyless inking systems typically have large diameter anilox meter rollers and form rollers since the image plate is large in area, for example a B2-size sheet format.

The reason for equal diameters of the rollers is so that history effects add "in-phase" with the image on the plate. The form roller then builds up a reproducible ink layer thickness "in phase" with the static offset plate image.

However, when changing print jobs from one static imaging plate to the next, there is thus some ghosting and some make ready printing necessary to erase the history of the prior ink film thickness distribution on the form roller. This make ready allows time for the new equilibrium ink film thickness to build up "in-phase" with a new plate image over time. Thus related art keyless systems still suffer from some ghosting and necessary make ready between print jobs.

For a variable data lithographic printing inker system, the ink film thickness must always be the same regardless of the imaging history because a new image is introduced on each pass of the printing process. This is because a new pattern of dampening solution is formed by laser evaporation on each pass of the imaging cylinder containing a reimageable print surface. In addition, variable data lithography is different from static offset lithography because the ink is transferred directly to an elastomeric conformable blanket that holds the latent image in the dampening fluid after it has been laser patterned in contrast to traditional offset which holds a static fluid pattern over a hard metal offset plate surface. Thus a new inker system must be designed to be compatible with the new requirements of a variable data lithography print system.

SUMMARY

Inker subsystems or inking systems that accommodate ghostless variable lithographic printing are disclosed. Inking methods, apparatus, and systems are provided that afford compact component configuration, metering of a uniform layer of ink onto the reimageable surface, cleaning ink from an ink form member, and recycling ink removed from the form member for resupply to an inking system. The form roller is always understood to apply ink directly to the reimageable surface used in variable lithographic printing. In is understood the term ink is used to apply to any viscous marking material in general.

In one embodiment, methods may include transferring ink from an anilox roll to the transfer roll at a first transfer nip, the first transfer nip being defined by the anilox roll and the transfer roll; and transferring ink from the transfer roll to the form roll at a second transfer nip, the second transfer nip being defined by the transfer roll and the form roll. In another embodiment, methods may include urging the transfer roll against the anilox roll to apply pressure to the ink at the first transfer nip; and urging the transfer roll against the form roll to apply pressure to the ink at the second transfer nip. By this method the pressure can be varied and allow for variations in ink transfer efficiency and average film thickness applied to the reimageable surface. This allows for small changes in the ink optical density and color saturation.

In another embodiment, methods may include cleaning a surface of the hard form roll. Cleaning the surface of the hard form roll may include removing ink from a surface of the form roll using a doctoring blade whereby ink is removed from the form roll. Methods may include collecting the ink removed from the hard surface of the form roll by the doctor blade in a reservoir. The reservoir may be in communication with an ink sump leading into the anilox roller. The collected ink may be received at the ink sump and reused for supplying the anilox roller with ink.

After the ink is transferred from the form roller to the reimageable surface of the central drum, some residual amount of dampening liquid will inevitably work its way into the inking subsystem. In another embodiment, methods include removing dampening liquid from the surface of the form roll. Methods may include contacting a surface of the form roll with a chamber blade in wiper mode, the chamber blade comprising a hydrophilic surface such as a hydrophilic foam rubber if a water based dampening fluid is used. Alternatively other blade materials may be used if a different dampening chemistry is used. For example, if a hydrofluoroether is used as the dampening fluid, a Teflon blade may be chosen. The blade material is chosen to selectively wet the dampening fluid over that of the ink.

Alternatively an air knife may be used to selectively evaporate away residual dampening fluid. Accordingly, ink may be collected from the form roll that is not contaminated with dampening fluid, and can be effectively reused for supplying the anilox roll. In another embodiment, methods include applying ink from the ink sump to a surface of the anilox roll. The supplied ink may include ink that has been removed from the form member, and recycled for supply to the anilox roll, and retransfer to the hard form member by way of the intermediate transfer roll.

In an embodiment of a variable lithographic inking apparatus, the inking subsystem may include an anilox member such as an anilox roll or hollow anilox drum. The anilox member has cells may be configured to carry ink from an ink sump to an ink transfer member. In an embodiment, the anilox member may be heated and temperature controlled; a temperature of the anilox member being adjustable to enhance ink transfer to the transfer member for achieving a different uniform ink layer thickness on a surface of the transfer member.

The ink transfer member may be a roller or drum. A surface of the transfer member is ideally a conformable elastomer in order to accommodate variations run out of the hard anilox roller and the hard form roller. A surface of the transfer member may comprise rubber or other soft material with durometer below 80 Shore; e.g., a hardness suitable for mitigating a metering pattern of the ink and smoothing the ink. The transfer member may be configured to define a first transfer nip with the anilox member. The transfer member may be movable for varying a pressure applied at the first transfer nip. For example, the transfer member may be configured to be urged against the anilox member to squeeze ink there between for metering a uniform layer of ink from the anilox member to the transfer member.

In an embodiment, apparatus may include a form roller member, the form member having a hard non-elastomeric surface, and the form member being configured to define a second transfer nip with the transfer member. A surface of the form member may comprise metal. The form member may be a roll or drum. The transfer member and the form member may define a second ink transfer nip. The transfer member may be configured to be urged against the form member to squeeze the ink at the nip for metering a uniform layer of ink onto the form member. The transfer member may be slowly oscillated in a direction perpendicular to the fast rotational motion of the anilox and form members in order to smooth out any transfer defects arising from cells holding ink in the anilox roll.

In order to slightly vary a thickness and/or optical density of a layer of ink transferred to the imaging plate, an angular velocity of a transfer member with respect to a form member and an anilox member may be adjustable for changing the thickness of ink transferred between the anilox member and inker form roller member. Further, an anilox member temperature, and/or an amount of pressure applied at the first and second ink transfer nips may be adjusted to achieve metering a uniform layer of ink for ghostless variable lithographic printing.

In an embodiment, the anilox roller member together with the form roller member and transfer member may include a chamber blade system which spans the extent of all three rollers, i.e. the anilox, transfer, and form roller members. A chamber blade system is composed of an enclosed chamber having at least two blades, one applied to an anilox member surface in the doctor mode with a high pressure impinging angle and one applied to a member surface at low pressure trailing angle which accepts return ink back into the chamber. In addition, sidewall stops are used to fully enclosed roller members at the edges of the member roller faces. Traditionally the doctor and wiper chamber blades form an enclosed chamber over one unique roller member. However a chamber may be formed multiple roller members as well. In an embodiment, the chamber blade system having a wiper blade placed in contact with the form member and a doctoring blade placed in contact with the anilox member in order to meter the ink into the cells of the anilox member. The chamber blade system thus forms a chamber over the anilox, transfer, and form roller members. Within the chamber, an additional doctor blade may be configured to contact a surface of the form member for removing ink from a surface of the form member for recycling back into the ink sump. The form member doctor blade may comprise metal, plastic, or other suitable material.

In an embodiment, apparatus may include a chamber blade system having a wiper blade, the wiper blade being configured to contact a surface of the form member, the wiper blade having a hydrophilic surface, and being configured to remove water based dampening fluid from the surface of the form member before removing ink from a surface of the form member by a form member doctor blade.

In an embodiment, apparatus may include the chamber blade system further comprising a removed ink reservoir, the removed ink reservoir being in communication with an ink sump, the ink sump being configured to accept removed ink from the removed ink reservoir. The ink sump may supply ink to the anilox member. For example, the anilox member may be arranged to contact ink in the ink sump to uptake the ink. The chamber blade system may further comprise an anilox member doctor blade, the anilox member doctor blade being configured to doctor excess ink from a surface of the anilox member so that it is metered in the cells of the anilox member.

In an embodiment of variable lithographic keyless inking systems, an inking system for transferring a uniform layer of ink to a reimageable surface may include an anilox member, an intermediate transfer member, and a form member, the intermediate member having a soft surface, and the form member having a hard surface. The anilox member and the intermediate transfer member may be arranged to define a first ink transfer nip, and the intermediate transfer member and the form member may be arranged to define a second ink transfer nip. The form member may be configured to transfer ink from the form member to a reimageable surface. The reimageable surface may have a conformable surface. For example, the imaging member may be a soft blanket with a surface layer composed of silicone, fluorosilicone, viton or other low surface energy material.

Another embodiment may include a chamber blade system, which may include an ink sump. The ink sump may be in communication with the ink reservoir for receiving ink cleaned from the form member. The received ink may thereafter be resupplied to the anilox member.

In another embodiment, a chamber blade system may include a wiper blade for removing dampening fluid from a surface of the form member. The chamber wiper blade may be configured to remove the dampening fluid before the removing ink by the doctor blade. Accordingly, the ink received by the reservoir is substantially free of dampening fluid, and may be resupplied to the anilox member and/or mixed with ink in the ink sump for supply to the anilox member.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
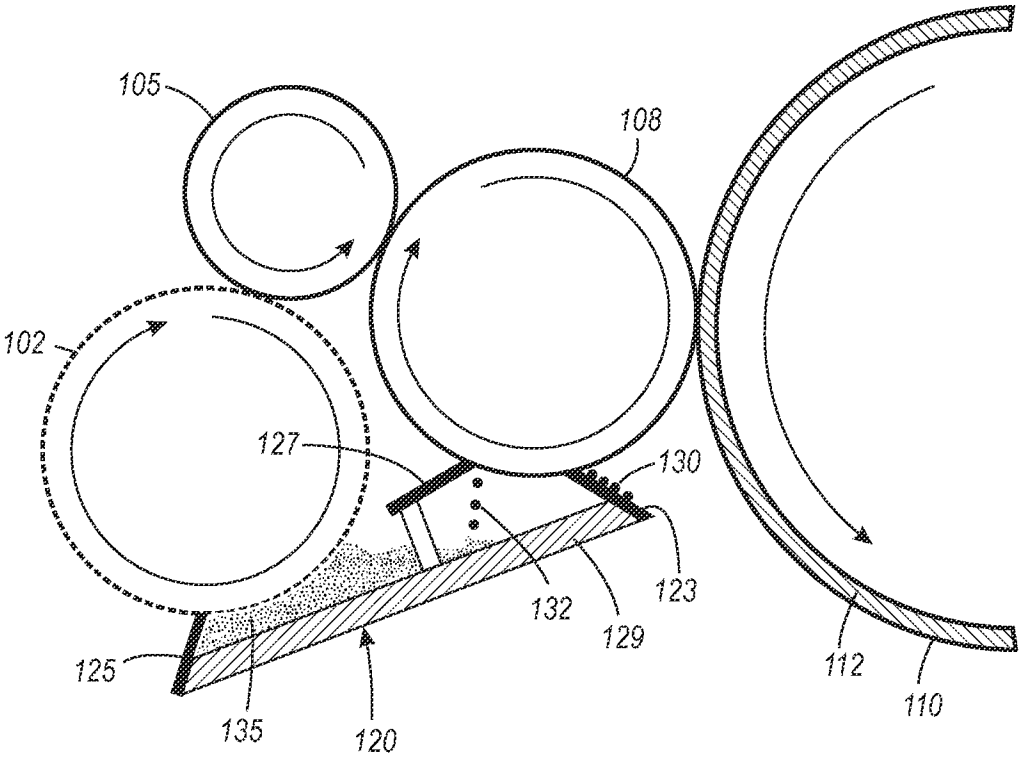
FIG. 1 shows a variable lithographic keyless inking system with a chamber blade system in accordance with an exemplary embodiment.

Exemplary embodiments are intended to cover all alternatives, modifications, and equivalents as may be included within the spirit and scope of the apparatus and systems as described herein.

Reference is made to the drawings to accommodate understanding of methods, apparatus, and systems for inking to a reimageable blanket surface for ghostless variable lithographic ink printing. In the drawings, like reference numerals are used throughout to designate similar or identical elements. The drawings depict various embodiments and data related to embodiments of illustrative methods, apparatus, and systems for inking from an inking member to the reimageable surface.

Compact variable lithographic keyless inking systems that reduce ghosting issues are provided. Methods, apparatus, and systems accommodate reduced or substantially eliminated ghosting by cleaning a hard ink transfer form member with a doctor blade to remove ink leftover after ink transfer to a reimageable surface. The removed ink may be recycled for resupply to an anilox roll of the inking system, and subsequent transfer to the form roll. The ink transfer members of the inking system need not be large or of equal size.

Inking systems or inker subsystems in accordance with embodiments may be incorporated into a variable lithographic architecture so that the inking system is arranged about a central drum holding an imaging member whose outer surface is a conformable reimageable surface layer. A paper path architecture may be situated about the imaging member to form a media transfer nip.

A uniform application of dampening fluid may be applied to the reimageable surface layer of the central imaging cylinder holding an imaging member using a dampening fluid subsystem. In the digital evaporation step, particular portions of the dampening fluid layer applied to the surface of the central imaging member may be evaporated by a digital evaporation system. For example, portions of the dampening fluid layer may be evaporated by laser patterning.

In an inking step, ink may be transferred from an inking system to the reimageable surface layer of the imaging member. The transferred ink adheres to portions of this surface where dampening fluid has been evaporated. In a partial cure step, the transferred ink may be partially cured by irradiation. For example, UV cure source(s) may be arranged about the imaging member. In an image transfer step, the transferred ink may be transferred to media such as paper at a media transfer nip.

A surface of the central imaging cylinder may be cleaned by a cleaning system. For example, tacky cleaning rollers may be used to clean the surface of the central imaging member. In a variable lithographic printing process, previously imaged ink must be removed from the imaging member to prevent ghosting. New ink applied to the imaging plate from an inking system should have no history of ink thickness depletion in the form roller due to prior ink transfer.

The inking system may include an inking member such as an anilox roll. The anilox roll may have wells or cells in a surface thereof for carrying ink to the imaging member. The wells may be mechanically or laser engraved, and may be configured to contain a volume of ink. The anilox roll may be configured in an inking system so that a surface of the roll is submerged in an ink chamber or ink sump. An anilox doctor blade may be arranged to contact a surface of the anilox roll for leveling ink supplied to the roll by the ink sump as the anilox roll rotates in a process direction.

The inking system may include an intermediate soft transfer roll. The transfer roll may have a soft, conformable surface made of, for example, a rubber such as EPDM or nitrile rubber that is compatible with the ink chemistry. The transfer roll may be configured to define a first ink transfer nip with the anilox roll. Ink may be metered onto the transfer roll at the first ink transfer nip. The transfer roll may be urged against the anilox roll to squeeze the ink at the first ink transfer nip to spread and smooth the ink as the ink is metered onto the transfer roll.

An ink form member such as a roll having a hard surface may be arranged to define a second transfer nip with the soft intermediate transfer roll. The ink form roll may be a cylindrical drum or other suitable member. The ink form roll may comprise a hard surface. For example, the ink form member may be a roll having a surface comprising metal. The ink member may be an aluminum drum. The drum may have a diameter in the range of about 2 to about 3 inches diameter. Alternatively, the ink form roll may have a highly durable, hard outer surface comprising plated chrome or an alumina ceramic coating.

The hard surface of the form member enables use of a doctor blade for cleaning ink from the form member. For example, a doctor blade may be applied to the surface of the form roll to wipe or scrape ink from the form member that is leftover after transferring ink to an imaging member. Ghostless variable data printing with offset ink requires that an inker subsystem form roll have substantially no prior ink history from a prior process of transferred ink onto an imaging plate. Because the surface of the form member is hard, the doctor blade can be applied without degrading the form member surface.

The intermediate transfer member may apply a pressure at the second transfer nip to squeeze the ink as the ink is metered onto the form member. The soft surface of the transfer member mitigates the metering pattern of the ink and facilitates spreading and smoothing of the ink at both the first and second transfer nips. The soft intermediate transfer member may be configured for oscillation back and forth against the first and second nips in alternating succession. Additional members such as rolls may be used to enhance ink smoothing.

A diameter of an intermediate transfer member such as a transfer roll and a form member such as a form roll may be different. Further, the anilox member, transfer member, and form member may have a diameter that is significantly smaller than related art anilox rolls, which are typically over 5 inches or more in diameter. Accordingly, an overall size of an inking systems having inking members in accordance with embodiments may have a reduced size, weight, and overall system cost in comparison with related art systems.

The intermediate member may be a transfer roll that is configured to rotate at a first angular velocity. The form member may be a form roll that is configured to rotate at a second angular velocity. At least one of the first angular velocity and the second angular velocity may be slightly adjusted to enhance smoothing and spreading of ink at the second ink transfer nip for metering a uniform layer of ink onto the hard surface of the form roll. Further, the anilox member may be a temperature controlled anilox roll. The temperature of the anilox roll may be adjusted to bring the ink to a temperature that enhances spreading and smoothing of the ink at, for example, the first transfer nip. Further, a pressure applied at the ink transfer nips may be adjusted by adjusting, for example, the pressure applied by the intermediate transfer member, to accommodate inks of particular thicknesses. These parameters may be adjusted for varying a thickness and optical density of an ink layer on a reimageable surface layer of an imaging member used in variable data lithography.

The form member may be configured to contact the outer reimageable surface layer and transfer ink without ink thickness variation or history of prior inking patterns onto the reimageable surface layer thereof. The imaging member and reimageable surface layer member may be configured as described by Stowe et al. in "Variable Data Lithography System" (U.S. patent application Ser. No. 13/095,714), as appropriate. For example the reimageable surface may be made from a soft silicone blanket material.

A chamber blade system in accordance with embodiments may include a removed ink reservoir. Chamber blade system may be located adjacent to a form member so that ink cleaned from the form member may be captured at the removed ink reservoir. The chamber blade system may include an ink sump. The ink sump may be configured to communicate with the removed ink reservoir, so that the ink sump may receive ink from the ink reservoir. For example, the chamber blade system may be constructed to define a cavity having an upper portion and a lower portion. The upper portion of the cavity may be positioned beneath a form roll, and may include an ink reservoir. Ink removed from the form roll may fall into the reservoir of the upper portion of the cavity. The lower portion of the ink cavity may include an ink sump. The ink reservoir and the ink sump of the cavity may share a common bottom member that contains the ink in the chamber blade system. Ink received at the reservoir may fall down the common bottom portion from the reservoir and into the ink sump.

A portion of the anilox member may be submerged in ink at the ink sump. For example, the anilox member may be an anilox roll that rotates through the ink contained in the ink sump whereby the ink sump supplies ink to a surface of the anilox roll. The ink may be contained in the cells of the anilox roll, and excess ink on a surface of the roll may be cleaned using an anilox doctor blade. The anilox doctor blade may be configured to doctor excess ink deposited in a cell of the inking member from the surface of the inking member. A chamber blade may be associated with the ink chamber. The chamber blade and the doctor blade may be configured to contain ink within the chamber. For example, the chamber blade and doctor blade, and bottom portion of the chamber blade system, in combination, may be configured to contain ink inside the ink chamber.

The chamber blade system may also include a form member doctor blade that is configured to contact a surface of the form member. The form member doctor blade may be formed of a material comprising metal. The form member doctor blade may be formed of a hard material that is suitable for scraping ink from a surface of the hard form member. The form member doctor blade may be oleophobic, and may comprise, for example, fluorocarbon materials such as TEFLON®. In an inking system having a chamber blade system in accordance with an embodiment, the form member doctor blade may be arranged to contact a portion of the form member that is located directly above and facing the removed ink reservoir of the chamber blade system. As the form roll, for example, rotates in a process direction, the form member doctor blade may contact the surface of the form member to remove ink from the surface of the form member, causing the ink to fall into the ink reservoir.

During transfer of the deposited ink from the form member to the imaging member, dampening fluid from the surface of the inking member may be transferred to the inking member. In an embodiment, a form member chamber blade may be made from a hydrophilic flexible material such as microporous nitrile butadiene rubber (NBR) which promotes the removal of water based dampening fluid from the surface of the ink coating the form member due to chemical diffusion away from the ink and into the chamber blade. Alternatively, if a hydrofluoroether based dampening fluid is used in digital variable lithographic, the form member chamber blade may be of a flexible fluorocarbon material such as viton which selectively promotes the removal of the hydrofluoroether dampening fluid from the ink by drawing it away from the surface. Thus the form member chamber blade material may be made of a flexible oleophobic material which promotes selective absorption and removal of the dampening fluid based upon the dampening fluid chemistry.

The form member chamber blade may be configured to contact a portion of the form member that includes ink and dampening fluid leftover form ink transfer at a third ink transfer nip defined by an imaging member and the form member. For example, with respect to a process direction, the form member chamber blade may be configured to contact a surface of the form member and remove dampening fluid therefrom before the form member doctor blade contacts a surface of the form member to remove leftover ink therefrom. Accordingly, ink removed from the surface of the form member may be substantially free of dampening fluid. The ink that is substantially free of dampening fluid may include a negligible amount of dampening fluid that is present in an amount that is low enough to be acceptable for resupply of the ink to the anilox member without degrading ink transfer or ink printing. As such, in an embodiment wherein the removed ink may be added to the ink sump for resupply to an anilox member, the ink supply may remain substantially free of dampening fluid. Accordingly, ink removed from the form member by cleaning the form member with the doctor blade may be recycled for resupply to the inking system.

FIG. 1 shows an apparatus and system for variable lithographic keyless inking in accordance with an embodiment. Specifically, FIG. 1 shows an inking apparatus having an anilox roll 102, an intermediate transfer roll 105, and a form roll 108. FIG. 1 shows the inking apparatus arranged with a digital imaging roll 110. While FIG. 1 shows components that are formed as rolls, other suitable forms and shapes may be implemented.

The anilox roll 102 is a cylindrical rotatable roll having cells or wells defined in a surface thereof. The cells may be mechanically or laser engraved. The anilox roll 102 may be submerged in supply ink, and may be rotated through the ink for uptaking ink into the cells. The anilox roll may be heated, and may be temperature controlled. Depending on properties of the ink being used, such as a viscosity of the ink, a temperature of the anilox member may be adjusted improved smoothing and spreading of the ink at one or more ink transfer nips of the inking system.

The intermediate transfer roll 105 may define a first ink transfer nip with the anilox roll 102. Ink carried by the anilox roll 102 may be carried to the first ink transfer nip, and metered onto the transfer roll 105 in a uniform layer. The intermediate roll 105 may have a diameter that is greater than or less than a diameter of the anilox roll 102. The transfer roll 105 may be driven passively through surface friction with the anilox roll in order to achieve a matching surface speed. The transfer roll surface thereby rotates in unison with surface of the anilox roll but the angular direction of rotation is opposite that of the anilox roll 102.

The intermediate transfer roll 105 may have a soft surface. For example, the surface may comprise rubber, or elastomer such as EPDM. The intermediate transfer roll 105 may be a rotatable drum, or other member suitable for defining an ink transfer nip with an anilox roll 102 and a hard form roll such as form roll 108. The soft intermediate transfer roll 105 may define a second transfer nip with the hard form roll 108. The intermediate transfer roll 105 may transfer ink from the anilox roll 102 to the hard form roll 108 in a uniform layer.

In an embodiment, the intermediate roll 105 may be configured to be urgable against the anilox roll 102 at the transfer nip for increasing a pressure applied to ink at the nip for squeezing the ink to spread and smooth the ink for metering the ink onto the intermediate transfer member in a uniform layer. In an embodiment, the transfer roll or member 105 may be urgable against the form roll or member 108 at the second ink transfer nip for increasing a pressure applied to ink at the nip for squeezing the ink to spread and smooth the ink for metering a uniform layer of ink onto the hard surface of the form roll 108. In an embodiment, the intermediate roll 105 may be configured to oscillate slowly back and forth in a direction perpendicular to the high speed rotation the anilox roll or member 102 and the form roll or member 108

In an embodiment, a transfer member such as transfer roll 105 may be rotatable and set to rotate at a velocity V1 set directly by a servo motor or indirectly through friction with the anilox roller 102. A form member such as form roll 108 may be rotatable and set to rotate at a velocity V2 set by an independent servo motor. In an embodiment, V2 may equal V1. Alternatively, V1 may differ from V2 slightly causing a small amount of controlled slippage. One or both of V1 and V2 may be adjusted to enhance uniformity of the ink layer transferred onto the hard form roll 108 from the soft intermediate transfer roll 105 at the second transfer nip. A diameter of the form roll 108 may be greater than or less than a diameter of the soft intermediate transfer roll 105.

As shown in FIG. 1, the form roll 108 may define a third ink transfer nip with an imaging member 110, and in particular, with a conformable, reimageable surface layer 112 of the imaging member 110. The imaging member 110 may be a roll as shown in FIG. 1, and the reimageable surface layer 112 may form an outer layer of the imaging member 110. Alternatively, the member may include a plate wrapped around a cylinder or a belt. The reimageable surface layer 112 is soft, conformable, and reimageable. For example, the surface layer 112 may comprise a silicone. An imaging member 110 may carry a surface layer 112 comprising, for example, a silicone imaging blanket. The surface layer 112 of the imaging roll 110 may be wear resistant and flexible. The digital imaging member or roll 110 may be configured to rotate in a direction that opposes a direction of rotation of the form roll 108. At the third transfer nip, ink may be metered form the hard form roll 108 to the digital imaging roll 110 in a uniform layer.

As the hard form roll 108 contacts the reimageable surface layer 112 at the third transfer nip to squeeze ink therebetween and transfer the ink onto the soft surface layer 112 of the imaging member 110, some ink may be left behind on the hard form roll 108. Further, as the hard form roll 108 contacts the digital imaging roll 110 at the third ink transfer nip to squeeze ink therebetween, dampening fluid deposited on the reimageable surface layer 112 prior to ink transfer may migrate from the digital imaging roll 110 to the hard form roll 108. Accordingly, the dampening fluid may be mixed with leftover ink on a surface of the form roll 108 that after ink transfer to the digital imaging roll 110 at the third transfer nip.

As shown in FIG. 1, a chamber blade system 120 may be positioned substantially below the inking apparatus. The chamber blade system 120 may include a chamber blade 123, an anilox doctor blade 125, and a form member doctor blade 127. The chamber blade system 120 may include a bottom portion 129. As shown in FIG. 1, the bottom portion 129, anilox doctor blade 125, and chamber blade 123 may together define a cavity. The bottom 129 of the chamber blade system 120 of FIG. 1 may angled downward, as shown, from a position adjacent to the form roll 108 at a first end of the bottom 129, to a position adjacent to the anilox roll 102 at a second end. The upper portion of the cavity may correspond to a removed ink reservoir, and the bottom portion of the cavity may correspond to an ink sump for supplying ink to the anilox roll 102.

Because the form roll 108 has a hard surface, the form roll doctor blade 127 may be configured to contact a surface of the form roll 108 for removing leftover ink from a surface of the form roll 108. The form roll doctor blade 127 may comprise a metal material, or other material suitable for removing ink from the hard surface of the form roll 108. The chamber blade system 120 may include a chamber blade 123. The chamber blade 123 may be configured to contact a surface of the form roll 108. The chamber blade 123 may comprise a flexible hydrophilic material if water based dampening solution is used, and thus the hydrophilic chamber blade 123 may wick away water-based dampening fluid 130 from the surface of the form roll 108. Alternatively if other dampening fluid chemistries are used, the chamber blade may be made of other materials designed to efficiently wick away the type of dampening fluid used. For example, if a hydrofluoroether based dampening fluid is used as the ink rejection layer in a variable data lithographic system, the chamber blade 123 may be chosen to me made from a fluoride rich fluorocarbon material such as viton or TEFLON.

Accordingly, in an embodiment having a form roll doctor blade 127 and a chamber blade 123, removed ink 132 removed by the doctor blade 127 may be received by the ink reservoir. The ink of the ink reservoir may flow or be caused migrate to an ink sump for mixing with supply ink 135. The supply ink 135 may contain the recycled removed ink 132, and may be supplied to the anilox roll 102. The recycled removed ink 132 advantageously would include substantially no dampening fluid after mixing in the ink sump with supply ink 135 because the dampening fluid is substantially removed from the form roll 108 before leftover ink is removed from a surface of the form roll 108. A negligible amount of dampening fluid may be present in the collected ink, even if a chamber blade is implemented to wick away the dampening fluid as disclosed.

As the anilox roll 102 rotates through the ink sump as shown in FIG. 1, an anilox doctor blade 125 may be configured to contact a surface of the anilox member 102 to level ink contained in the cells of the anilox member 102. The anilox doctor blade 125, chamber blade system bottom portion 129, and hydrophilic chamber blade system may be constructed and arranged to together contain the ink of the removed ink reservoir and/or the ink sump. The chamber blade system 120 may span both the anilox roll 102 and the form roll 108, an arrangement that may reduce an overall size of the inking system, and thus reduce costs. In an alternative embodiment, an air knife (not shown) may be implemented to selectively evaporate away residual dampening fluid. The air knife may be configured to direct an air stream near a proximity of a form roll surface for removing dampening fluid from the form roll and/or a surface of ink on the form roll.

Figure 2:
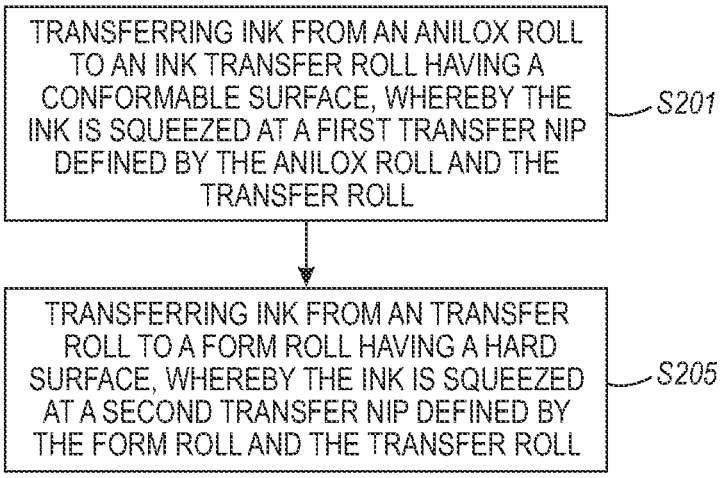
FIG. 2 shows a variable lithographic keyless inking metering process in accordance with an exemplary embodiment.

FIG. 2 shows methods for variable lithographic keyless inking metering in accordance with an embodiment. Specifically, methods for metering may include transferring ink from an anilox member such as a roll to an ink transfer member, which may be a soft rotatable roll, at S201. The anilox roll and the transfer roll may define a first ink transfer nip. A pressure may be applied to ink at the nip at S201 for achieving transfer of a uniform layer of ink onto a surface of the transfer roll.

Methods may include transferring ink from the transfer roll to an ink form member such as a form roll at S205. While the transfer roll has a soft surface comprising, for example, rubber, the form roll has a hard surface comprising, for example, metal. The form member and the transfer member define a second ink transfer nip at which ink is squeezed by the form roll and the transfer roll at S205.

Figure 3:
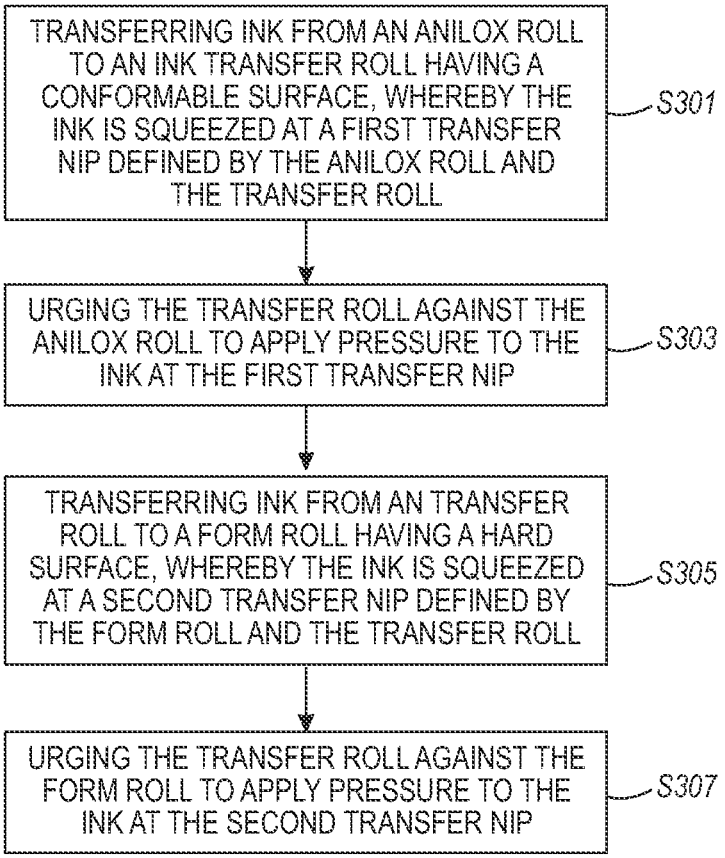
FIG. 3 shows a variable lithographic keyless inking metering process in accordance with an exemplary embodiment.

The pressure applied at the nip may be adjustable. For example, the intermediate transfer member or roll may be movable for urging against at least one of the anilox roll and the hard form roll. FIG. 3 shows methods for variable lithographic keyless inking metering in accordance with an embodiment. Specifically, methods may include transferring ink from an anilox roll to an ink transfer roll having a conformable surface, whereby the ink is squeezed at a first transfer nip defined by the anilox roll and the transfer roll at S301. At S303, the transfer roll may be urged against the anilox roll to apply a pressure, or to, e.g., increase a pressure against the ink at the transfer nip during metering.

Methods may include transferring the ink from the transfer roll to a form roll having a hard surface at S305. Accordingly the ink may be squeezed at a second ink transfer nip defined by the transfer roll and the hard form roll. At S307, the transfer roll may be urged against the hard form roll and the ink at the second transfer nip to, e.g., apply or increase a pressure against ink at the nip during metering. S301-S307 may be implemented using a transfer roll that is configured to slowly oscillate back and forth in a direction perpendicular to the motion of the rollers shown in FIG. 1. This perpendicular oscillatory motion smooths out the delivery of ink from the anilox roller such the cell structure point defects are removed.

Figure 4:
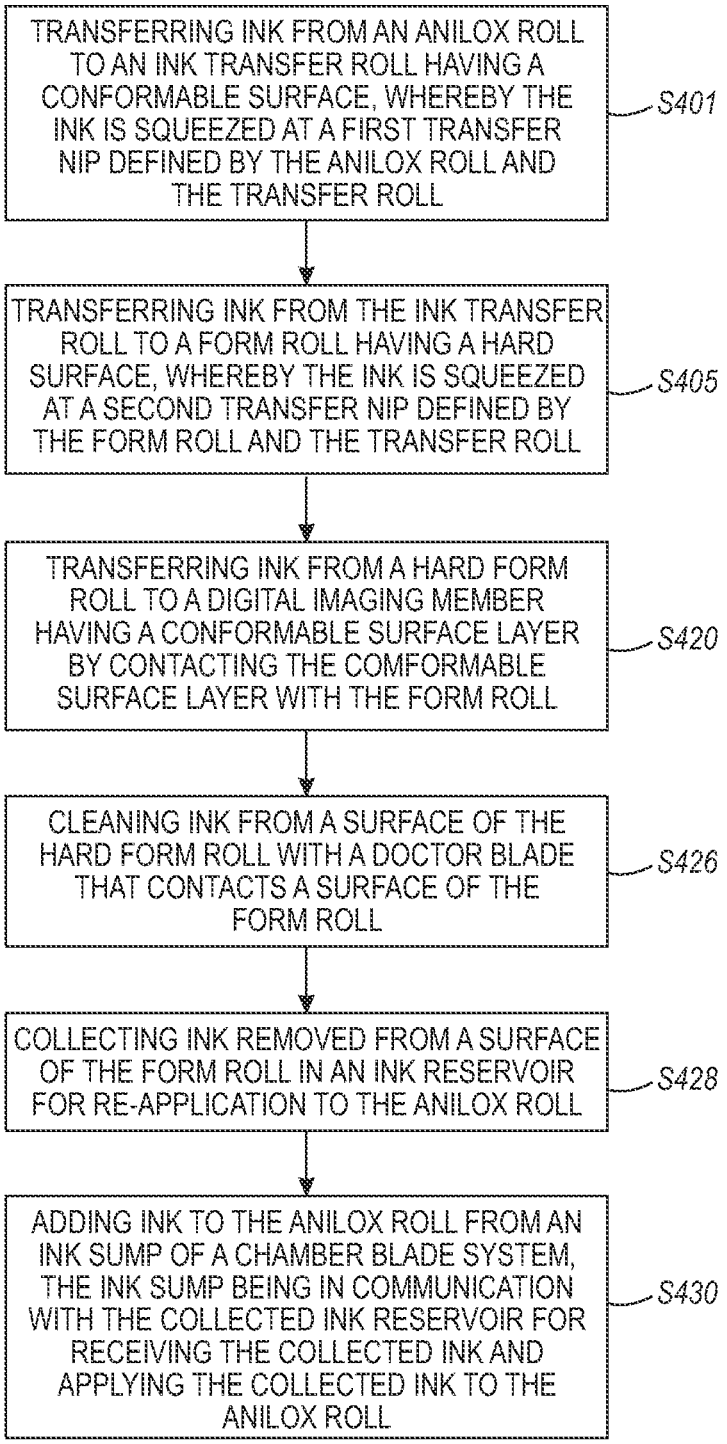
FIG. 4 shows a variable lithographic keyless inking ink supply, metering, transfer, cleaning, and recycling process in accordance with an exemplary embodiment.

FIG. 4 shows methods for variable lithographic keyless inking, including ink supply, metering, transfer, cleaning, and recycling methods in accordance with an embodiment. Specifically, methods may include transferring ink from an anilox roll to an ink transfer roll having a conformable surface at S401. The anilox roll and the transfer roll may define a first ink transfer nip at which ink may be squeezed and spread during metering of the ink from the anilox member to the transfer member at S401.

At S405, the ink metered in a uniform layer onto a surface of the transfer roll may be transferred from the transfer roll to a hard form roll. The form roll may have a hard surface, and may comprise, for example, metal. The ink may be squeezed at a second transfer nip defined by the conformable transfer roll and the hard form roll to meter a uniform layer of ink onto the form roll.

At S420, the ink may be transferred from the hard form roll to an imaging member such as a digital imaging plate or roll. The hard transfer roll and the imaging roll may define a third ink transfer nip. The imaging member includes a soft, conformable reimageable surface layer onto which the ink is transferred from the form roll. For example, the surface layer of the imaging member may comprise silicone or a fluorosilicone. As shown at S426, methods may include cleaning ink from a surface of the form roll that is left over after transfer of ink from the form roll to the imaging roll at S420. The ink may be cleaned from a surface of the hard form roll using a form roll doctor blade for scraping or wiping ink from the surface of the form roll. In another embodiment, methods may include removing dampening fluid from the leftover ink before removing the ink from the surface of the hard form roll at S420. For example, if a water-based dampening fluid is used, a hydrophilic chamber blade may be positioned near the form roll for contacting the left over ink on the form roll after image transfer to the imaging roll. The chamber blade may wick away the water-based dampening fluid from the leftover ink.

As shown at S428, methods may include collecting the leftover ink cleaned from a surface of the hard form roll with the form roll doctor blade in a reservoir of a chamber blade system. In an embodiment wherein a chamber blade is used to remove dampening fluid from the leftover ink before the removing the ink from the form roll at S420, the collected ink may be substantially free of dampening fluid.

As shown at S430, methods may include adding or supplying ink to the anilox roll from an ink sump of the chamber blade system. The ink sump may be in communication with the removed ink reservoir. Accordingly, the ink reservoir may collect removed ink from the hard form roll, and the collected ink may be transferred to the ink sump for resupply to the anilox roll. The ink sump may contain a mixture of new, unused ink and recycled ink that is supplied to the anilox roll at S430.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A variable lithographic keyless inking method, comprising:

metering a uniform layer of ink onto a hard form roll from a transfer roll, the transfer roll having a conformable surface;

transferring the ink of the uniform layer directly from the hard form roll to a reimageable surface layer for variable data lithographic printing;

cleaning a surface of the hard form roll, the cleaning comprising removing ink from the surface of the hard form roll; and removing dampening fluid from the surface of the hard form roll, the dampening fluid being transferred from the reimageable surface layer to the hard form roll, wherein the removing dampening fluid includes contacting the surface of the hard form roll with a chamber blade, the chamber blade comprising a material configured to chemically wick away dampening fluid from the surface of the hard form roll before removing ink from the surface of the hard form roll.

2. The method of claim 1, the removing ink further comprising contacting the surface of the hard form roll with a doctor blade whereby ink is removed from the hard form roll.

3. The method of claim 2, further comprising transferring ink from an anilox roll to the transfer roll at a first transfer nip, the first transfer nip being defined by the anilox roll and the transfer roll; and collecting the ink removed from the surface of the hard form roll by the doctor blade in a reservoir, the reservoir being in communication with an ink sump wherein collected ink may mix with ink for applying to the anilox roll.

4. The method of claim 3, further comprising applying ink from the ink sump to a surface of the anilox roll.

5. The method of claim 1, the metering further comprising transferring ink from an anilox roll to the transfer roll at a first transfer nip, the first transfer nip being defined by the anilox roll and the transfer roll;

transferring ink from the transfer roll to the hard form roll at a second transfer nip, the second transfer nip being defined by the transfer roll and the hard form roll;

urging the transfer roll against the anilox roll to apply pressure to the ink at the first transfer nip; and urging the transfer roll against the hard form roll to apply pressure to the ink at the second transfer nip.

6. The method of claim 5, further comprising actively driving a surface velocity of at least one of the anilox member, the intermediate transfer member, and the form member to vary the relative surface velocity of a first one of the anilox member, the intermediate transfer member, and the form member with a second of the anilox member, the intermediate transfer member, and the form member to slightly adjust the ink transfer efficiency and final optical saturation of ink delivered to the reimageable surface of a variable lithographic printing apparatus.

7. A keyless variable lithographic inking apparatus, comprising:

an anilox member, the anilox member being configured to carry ink;

a transfer member, the transfer member having a conformable surface, and the transfer member being configured to define a first transfer nip with the anilox member; and a form member, the form member having a hard surface, and the form member being configured to define a second transfer nip with the transfer member; and an imaging member, the imaging member having a conformable reimageable surface layer, and the reimageable surface layer being configured to define a third transfer nip with the form member;

a chamber blade system, the chamber blade system having a form member doctor blade, the form member doctor blade being configured to contact a surface of the form member for removing ink from the surface of the form member, and a chamber blade, the chamber blade being configured to contact a surface of the ink covering the form member and being configured to chemically remove dampening fluid from the surface of the ink covering the form member before the removing ink from the surface of the form member by the form member doctor blade.

8. The apparatus of claim 7, the chamber blade system further comprising a removed ink reservoir, the removed ink reservoir being in communication with an ink sump, the ink sump being configured to accept removed ink from the removed ink reservoir, the anilox member being configured to contact ink in the ink sump to uptake the ink.

9. The apparatus of claim 8, further comprising an anilox member doctor blade, the anilox member doctor blade being configured to doctor excess ink from a surface of the anilox member.

10. The apparatus of claim 7, the anilox member being heated and temperature controlled, a temperature of the anilox member being adjustable to enhance metering for achieving a uniform ink layer on a surface of the transfer member.

11. A variable lithographic keyless inking system, comprising:

an inking system for transferring a uniform layer of ink to a reimageable surface layer of an imaging member, the inking system having an anilox member, an intermediate transfer member, and a form member, the intermediate member having a soft surface, and the form member having a hard surface, the anilox member and the intermediate transfer member defining a first ink transfer nip, and the intermediate transfer member and the form member defining a second ink transfer nip, the form member being configured to transfer ink from the form member to the reimageable surface, the reimageable surface layer being a soft surface; and a chamber blade system, the chamber blade system having a form member doctor blade, the form member doctor blade being configured to contact the form member for removing ink from the form member, the chamber blade system having a reservoir for receiving the ink removed from the form member, and a chamber blade comprising a material configured to chemically wick dampening fluid from a surface of the ink coating the form member, the chamber blade being configured to chemically wick the dampening fluid before the removing ink by the doctor blade whereby the ink received by reservoir is substantially free of dampening fluid.

* * * * *